United States Patent [19]

Sadler et al.

[11] 3,947,039

[45] Mar. 30, 1976

[54] FOOTBALL BOARD GAME APPARATUS

[76] Inventors: John W. Sadler; Theodore J. Sadler, both of 2015 Cypress Drive, Bel Air, Md. 21014

[22] Filed: Sept. 18, 1974

[21] Appl. No.: 507,245

[52] U.S. Cl. ..... 273/134 CF; 273/94 E

[51] Int. Cl.[2] ..... A63F 3/00

[58] Field of Search ..... 273/94, 134

[56] References Cited

UNITED STATES PATENTS

| | | | |
|---|---|---|---|
| 1,526,092 | 2/1925 | Robertson | 273/94 |
| 2,049,284 | 7/1936 | Anderson | 273/134 CF UX |
| 3,043,594 | 7/1962 | Seitz | 273/94 R |

*Primary Examiner*—Delbert B. Lowe

*Attorney, Agent, or Firm*—Roylance, Abrams, Berdo & Kaul

[57] ABSTRACT

A football game apparatus comprising a game board having a model football field thereon and a playing piece movable therealong, an offensive play board having offensive player selected columns corresponding to offensive plays and chance selected rows intersecting with the columns to define offensive blocks, each containing yardage values, and a defensive play board having defensive player selected columns corresponding to defensive plays and chance selected rows intersecting with the columns to define defensive blocks, each containing yardage values, wherein the values obtained in the selected offensive and defensive blocks are compared to determine the net yardage of each play and the corresponding movement of the playing piece. Substitute offensive and defensive columns are provided to vary the offensive and defensive yardage values. Certain offensive and defensive blocks contain turn-over indicia which, when matched, result in the turn-over of possession of the playing piece between players.

10 Claims, 16 Drawing Figures

| | #1 RUSH | #2 RUN | #3 PASS SHORT | #4 PASS LONG |
|---|---|---|---|---|
| 3 | 10 FUM | 4 | 17 FUM | 53 INC |
| 4 | 10 FUM | 13 | 19 INC | 27 INT |
| 5 | 8 | 11 | 13 INC | 63 INC |
| 6 | 6 FUM | 0 OR -15 PEN | 10 INC | 21 INC |
| 7 | 9 | 10 | 18 INC | 29 INC |
| 8 | 6 | 12 | 13 INC | 25 INC |
| 9 | 5 | 0 | 6 INT | 23 INC |
| 10 | 3 | 3 | 15 INT | 30 FUM |
| 11 | 3 | 5 | 10 INC OR - 5 PEN | 20 INC |
| 12 | 3 | 4 FUM | 12 INT | 21 INC |
| 13 | 4 | 9 FUM | 6 INC | 23 INC |
| 14 | 9 | 5 | 8 INC | 23 INC |
| 15 | 0 OR - 5 PEN | 1 | 8 INC | 19 INC |
| 16 | 8 | 0 | 12 INC | 35 INT |
| 17 | 0 | 7 FUM | 15 INT | 25 INC |
| 18 | 10 | 18 FUM | 9 INC | 15 INC OR - 5 PEN |

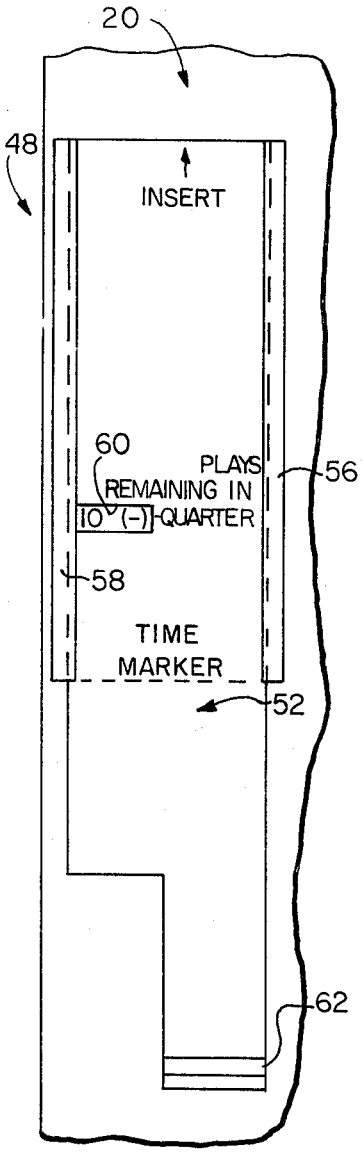
FIG. 3
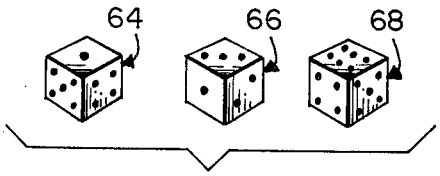
FIG. 4
| | 72 #1 RUSH | 74 #2 RUN | 76 OFFENSE #3 PASS SHORT | 78 #4 PASS LONG |
|---|---|---|---|---|
| 3 | 10 FUM | 4 | 17 FUM | 53 INC |
| 4 | 10 FUM | 13 | 19 INC | 27 INT |
| 5 | 8 | 11 | 13 INC | 63 INC |
| 6 | 6 FUM | 0 OR −15 PEN | 10 INC | 21 INC |
| 7 | 9 | 10 | 18 INC | 29 INC |
| 8 | 6 | 12 | 13 INC | 25 INC |
| 9 | 5 | 0 | 6 INT | 23 INC |
| 10 | 3 | 3 | 15 INT | 30 FUM |
| 11 | 3 | 5 | 10 INC OR −5 PEN | 20 INC |
| 12 | 3 | 4 FUM | 12 INT | 21 INC |
| 13 | 4 | 9 FUM | 6 INC | 23 INC |
| 14 | 9 | 5 | 8 INC | 23 INC |
| 15 | 0 OR −5 PEN | 1 | 8 INC | 19 INC |
| 16 | 8 | 0 | 12 INC | 35 INT |
| 17 | 0 | 7 FUM | 15 INT | 25 INC |
| 18 | 10 | 18 FUM | 9 INC | 15 INC OR −5 PEN |
70 88 80 82 84 86
FIG. 5

90

| | 92 | 94 | 96 | 98 | 100 | 102 |
|---|---|---|---|---|---|---|
| | DEFENSE | | | | | |
| | RUN TYPE DEFENSE AGAINST RUSH OR RUN #1 | RUN TYPE DEFENSE AGAINST SHORT PASS #2 | RUN TYPE DEFENSE AGAINST LONG PASS #3 | PASS TYPE DEFENSE AGAINST RUSH OR RUN #4 | PASS TYPE DEFENSE AGAINST SHORT PASS #5 | PASS TYPE DEFENSE AGAINST LONG PASS #6 |
| 3 | 7 | 5 | 2 INT | 6 | 5 INC | 14 INC |
| 4 | 6 | 4 | 6 INC | 5 | 4 | 12 INC |
| 5 | 5 | 3 | 5 INT | 4 | 4 OR -5 PEN | 10 INC |
| 6 | 0 OR -5 PEN | 0 INC | 4 INC | 3 | 0 INC | 8 INC |
| 7 | 3 | 0 OR -15 PEN | 3 INC | 2 | 1 FUM | 6 INC |
| 8 | 2 | 0 INC | 2 INC | 1 FUM | 6 INC | 4 INC |
| 9 | 1 FUM | 0 INC | 1 INC | 0 FUM | 3 FUM | 2 INC |
| 10 | 0 | 0 | 0 FUM | 0 | 2 INC | 0 INC |
| 11 | 0 FUM | 0 INC | 0 INC | 0 | 5 INT | 0 FUM |
| 12 | 1 FUM | 0 FUM | 1 INC | 0 | 5 INC | 2 INC |
| 13 | 2 | 0 INT | 2 INC | 1 | 0 INT | 4 INC |
| 14 | 3 | 0 | 3 INC | 2 | 1 INC | 6 INT |
| 15 | 4 | 0 INC | 4 INC | 3 | 2 INC | 8 INC |
| 16 | 5 | 3 INT | 5 INC | 0 OR - 15 PEN | 6 INT | 10 INC |
| 17 | 0 | 4 | 6 INC | 5 | 3 | 12 INC |
| 18 | 7 | 5 | 7 INT | 6 | 5 INT | 14 INC |

106 108 110 112 86

FIG. 6

124

| #1 DEFENSE |
|---|
| 5 |
| 0 |
| 4 |
| 5 |
| 3 |
| 6 |
| 0 FUM |
| 1 FUM |
| 7 |
| 7 |
| 2 |
| 2 |
| 0 |
| 3 |
| 0 OR -5 PEN |
| 1 FUM |

126 128

| #2 DEFENSE | #3 DEFENSE |
|---|---|
| 0 | 0 FUM |
| 0 INC | 4 INC |
| 0 INC | 4 INC |
| 3 | 5 INC |
| 0 | 1 INC |
| 5 | 2 INT |
| 5 | 7 INT |
| 0 OR - 15 PEN | 3 INC |
| 3 INT | 5 INT |
| 4 | 6 INC |
| 0 INC | 3 INC |
| 4 | 6 INC |
| 0 INC | 2 INC |
| 0 FUM | 1 INC |
| 0 INT | 2 INC |
| 0 INC | 0 INC |

FIG. 11 FIG. 12

156

| | 144 KICK OFF | 146 KICK OFF RETURN | 148 PUNT | 150 PUNT RETURN | 152 ON SIDE KICK | 154 |
|---|---|---|---|---|---|---|
| 3 | 70 | 3 | 45 OR -15 PEN | 2 FUM | 11 | |
| 4 | 76 158 | 25 160 | 70 | 70 | 13 KTB | |
| 5 | 65 | 16 | 58 162 | 10 | 16 KTB | |
| 6 | 55 | 15 | 48 | 9 164 | 10 | |
| 7 | 62 | 14 | 40 | 4 | 166 16 | |
| 8 | 71 | 23 | 37 | 3 | 14 | |
| 9 | 49 | 11 | 44 | 0 | 12 | |
| 10 | 50 | 10 | 35 | 1 | 13 | |
| 11 | 51 | 9 | 50 | 4 | 11 KTB | |
| 12 | 52 | 10 | 49 | 5 | 11 | |
| 13 | 56 | 12 | 47 | 6 | 13 | |
| 14 | 59 | 14 | 40 | 8 | 17 | |
| 15 | 61 | 18 | 50 | 17 | 10 | |
| 16 | 41 | 1 | 46 | 0 | 17 | |
| 17 | OUT OF BOUNDS -5 PEN | 20 | 45 OR -5 PEN | ROUGHING KICKER -15 PEN | 14 KTB | |
| 18 | 67 | 90 | 0 BLOCKED | 23 | 12 KTB | |

FIG. 16

130

| #4 DEFENSE |
|---|
| 2 |
| 1 FUM |
| 3 |
| 5 |
| 4 |
| 2 |
| 6 |
| 6 |
| 0 |
| 0 |
| 0 FUM |
| 3 |
| 0 |
| 1 |
| 5 |
| 0 OR -15 PEN |

FIG.13

132 134

| #5 DEFENSE | #6 DEFENSE |
|---|---|
| 2 INC | 10 FUM |
| 5 INT | 6 INC |
| 5 INC | 14 INC |
| 1 FUM | 2 INC |
| 3 FUM | 0 FUM |
| 5 INT | 10 INC |
| 5 INC | 6 INT |
| 6 INT | 12 INC |
| 4 | 12 INT |
| 2 INC | 8 INC |
| 1 INC | 2 INC |
| 4 | 4 INC |
| 3 OR -5 PEN | 0 INC |
| 0 INC | 8 INC |
| 6 INC | 4 INC |
| 0 INT | 14 INC |

FIG.14

136 138

| | FIELD GOAL | | | | |
|---|---|---|---|---|---|
| | 10 YDS OR LESS | 20 YDS OR LESS | 30 YDS OR LESS | 40 YDS OR LESS | 50 YDS OR LESS |
| 3 | BAD | BAD | GOOD | BAD 20 YDS | GOOD OR -15 PEN |
| 4 | GOOD | BAD BLOCKED | GOOD | GOOD OR -5 PEN | GOOD |
| 5 | GOOD | GOOD | BAD | BAD BLOCKED | BAD 20 YDS |
| 6 | GOOD | GOOD | GOOD | BAD 30 YDS | BAD 30 YDS |
| 7 | GOOD | GOOD | GOOD OR -5 PEN | GOOD | BAD 40 YDS |
| 8 | GOOD | GOOD OR -5 PEN | GOOD | BAD 40 YDS | GOOD |
| 9 | GOOD OR -15 PEN | GOOD | BAD | GOOD | BAD BLOCKED |
| 10 | GOOD | GOOD | GOOD | BAD | BAD |
| 11 | GOOD OR -5 PEN | GOOD | GOOD | BAD | BAD |
| 12 | GOOD | GOOD OR -15 PEN | GOOD | GOOD | BAD 50 YDS |
| 13 | GOOD | GOOD | BAD | BAD | BAD 40 YDS |
| 14 | GOOD | GOOD | GOOD OR -15 PEN | GOOD | BAD 40 YDS |
| 15 | GOOD | GOOD | GOOD | BAD OR -15 PEN | GOOD |
| 16 | GOOD | BAD | BAD BLOCKED | BAD | BAD -5 PEN |
| 17 | BAD BLOCKED | BAD | BAD | BAD BLOCKED | GOOD |
| 18 | GOOD | BAD BLOCKED | BAD | BAD | GOOD |

140 142

FIG. 15

FOOTBALL BOARD GAME APPARATUS

The present invention relates to game apparatus and more particularly to apparatus by which the game of football may be played on a game board in connection with offensive and defensive play boards and chance controlled means.

The game of football evokes great interest on the part of sports fans and the public in general, and accordingly many attempts have been made to produce a successful simulation of this game by way of game boards and associated apparatus. However, such games usually only vaguely resemble the actual game of football in that they employ a simulated football field and follow rudimentary football rules. While such games may be interesting to those having little knowledge of the actual football game, their failure to provide the opportunity to use strategy and tactics employed in actual football leaves most true football fans unsatisfied. A primary defect of such prior-art games is that the element of chance usually plays too great a part in the determination of the winner of the game. Additionally, most games, although played by two persons, usually require the active participation of only one player at a time. Accordingly, for the player not actively participating the game can be rather boring. Moreover, many prior-art games fail to give the players a chance to choose their offensive and defensive plays.

Accordingly, it is a principal object of the present invention to provide a unique and stimulating football game.

Another object is to provide a football game which allows the players to select different defenses and offensive plays as the game proceeds and which rewards each player in accordance with his skill in selecting the proper move.

Another object is to provide a football game which is not completely ruled by chance.

Another object is to provide a football game in which both players are actively involved in the game simultaneously.

Another object is to provide a football game in which the players can choose their plays, both offensive and defensive.

The foregoing objects are attained by providing a football game apparatus comprising im combination a game board having a model football field thereon divided transversely into yardage with end zones at both ends; a playing piece movable along the game board yardage; an offensive play board divided into a plurality of offensive columns, each column representing a type of offensive play, one of which is chosen by the offensive player, and a plurality of offensive rows, one to be selected by a chance controlled means, the intersection of the player selected columns and the chance controlled means selected rows defining a plurality of offensive blocks; offensive yardage indicia means, located in the offensive blocks, for indicating an offensive play value; a defensive play board divided into two sets of defensive columns, each column representing a type of defensive play, one of the sets being chosen by the defensive player and one of the columns in the chosen set being determined by matching it with the chosen offensive column, and a plurality of defensive rows, one to be selected by a chance controlled means, the intersection of the player selected columns and the chance controlled means selected rows defining a plurality of defensive blocks; defensive yardage indicia means located in the defensive blocks for indicating a defensive play value; and chance controlled means actuated for each play for selecting one of said offensive blocks containing offensive yardage indicia means and one of said defensive blocks containing defensive yardage indicia means, which, when tabulated, determine the resultant play value and the movement of the playing piece in the direction indicated by the resultant play value.

Additionally, substitute offensive and defensive columns are provided in order to vary the offensive and defensive yardage indicia means. Some of the offensive blocks and some of the defensive blocks also contain turn-over indicia which, when coinciding in these blocks, indicate a turn-over of the playing piece from the offensive player to the defensive player. In addition, a field goal board is provided as is a kick play board containing kickoff, punt and on-side kickoff information.

Other objects, advantages and salient features of the present invention will become apparent from the following detailed description which, taken in conjunction with the annexed drawings, discloses a preferred embodiment of the present invention.

Referring now to the drawings which form a part of this original disclosure:

FIG. 3 illustrates the play counter in another position;

FIG. 4 illustrates suitable chance controlled means which can be the three dice shown therein;

FIG. 5 illustrates an offensive play board divided into columns and rows with offensive blocks defined therein;

FIG. 6 illustrates a defensive play board divided into columns and rows with defensive blocks defined therein;

FIGS. 11–14 illustrate substitute defensive columns for varying the indicia in the defensive blocks;

FIG. 15 illustrates a field goal board having field goal blocks therein; and FIG. 16 illustrates a kick play board for tabulating the results of various kicking plays other than field goals.

Figure 1:
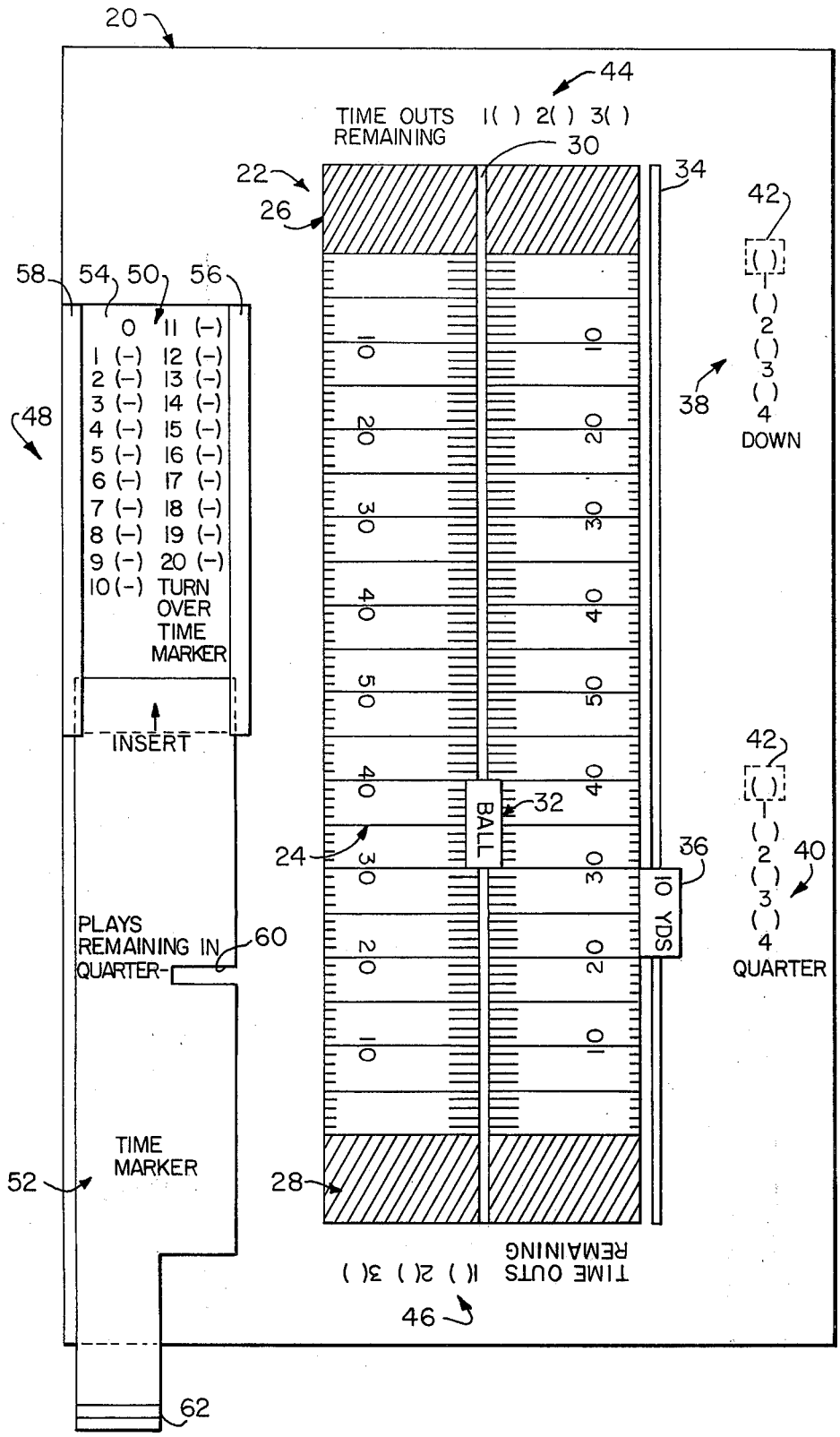
FIG. 1 illustrates a simulated football field game board having, among other things, a movable playing piece or ball thereon, as well as a play counter.

Referring now to FIG. 1, the game board 20 is shown having a model football field 22 thereon subdivided into yardage lines 24 with two end zones 26 and 28 located at opposite ends of the football field 22.

Running down the center of the field 22 is a strip 30 extending upward from the surface of the game board 20 and, preferably, having a rectangular cross section. Mounted for movement along this strip 30 is a playing piece 32 representing the football. The playing piece 32 preferably has a slot with a rectangular cross section on the bottom side thereof so as to be receivable on the strip 30 and movable therealong. A similar yard marker strip 34 is positioned adjacent one edge of the model football field 22 and extends the full length thereof. This strip can also be raised above the surface of the game board and have a rectangular cross section so as to receive thereon a ten yard marker 36 which has a slot with a rectangular cross section in the bottom surface thereof so as to be received by and movable along the yard marker strip 34. The ten yard marker 36 should have a length equal to ten of the yardage lines 24 so as to function like an actual ten yard marker in actual football play. The position of the playing piece 32 represents the position on the football field 22 of the football.

Additionally located on the top of the game board 20 is a down counter 38 and a quarter counter 40. Each is comprised of indicia numbered 1 through 4 coverable by a cap 42 so as to indicate the number of the down and the number of the quarter. Similarly, two time out counters 44 and 46 are provided, one for each team, to designate the number of time outs remaining for each of the players of the game. A cap similar to that shown with the down and quarter counters can be utilized to designate the remaining time outs.

Also located on the top of the game board 20 is a play counter 48 which is comprised of a list 50 of the number of plays remaining and a movable time marker 52. The list 50 which, as illustrated, can number from 0 to 20, is contained in a rectangular sheet 54 coupled to the top of the game board 20 which has guide sleeves 56 and 58 on opposing edges thereof. The time marker 52 is preferably formed from a thin sheet of rectangular shaped carboard having edges fitting into the guide sleeves 56 and 58, the time marker 52 being movable therealong. A slot 60 is located in one edge of the time marker 52 and an upstanding handle 62 is located at one end.

Figure 2:
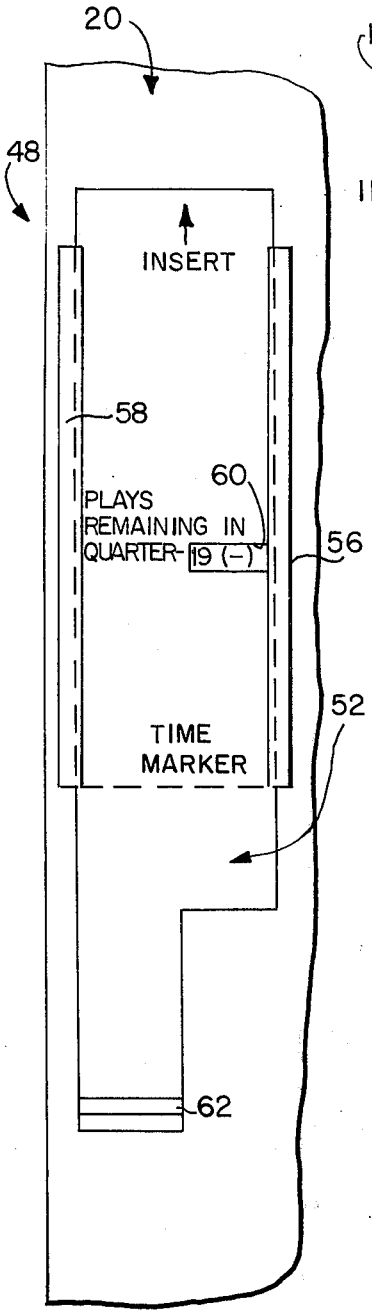
FIG. 2 illustrates the play counter in a different position than that shown in FIG. 1.

Referring now to FIG. 2, the play counter 48 is shown with the time marker 52 moved along the guide sleeves 56 and 58 to such a position that the slot 60 overlies the number 19 designating that 19 plays are left in the specific quarter in which play is presently taking place. When the time marker 52 is moved down to a position in which the slot 60 overlies the number 11 on the sheet 54, the time marker 52 is pulled from the guide sleeves, is turned over, and is reinserted into the guide sleeves so that the slot 60 overlies the number 10 on the sheet 54, as illustrated in FIG. 3. The remaining plays in the quarter are then kept track of by moving the time marker 52 toward the O indication on sheet 54 shown in FIG. 1.

Referring now to FIG. 4, three dice, designated 64, 66 and 68, are shown and represent one of the possible chance controlled devices utilized with the subject invention. Each of the dice is a conventional one having six sides with a number 1 through 6 located thereon. This form of chance controlled device is preferable since, as described in more detail hereinafter, the various play boards utilized will have rows numbered 3 through 18, which correspond to the numbers obtainable when the three dice are rolled. Of course, one die can be utilized three times or a spinner could be utilized which is surrounded by a seriies of numbered blocks. While only one set of three dice is shown, it is contemplated that two sets can be utilized, one for each of the two players.

Referring now to FIG. 5, the offensive play board 70 is shown having four offensive columns and sixteen offensive rows. A first offensive column 72 is labelled "Rush", a second offensive column 74 is labelled "Run", a third column 76 is labelled "Short Pass", and a fourth column 78 is labelled "Long Pass". Each of the sixteen horizontal offensive rows 80 has a number at the side thereof, these numbers running from 3 to and including 18 which correspond to the numbers rollable by the set of three dice shown in FIG. 4. The intersections of the offensive columns and the offensive rows define a plurality of offensive blocks 82, each containing numerical offensive yardage indicia 84 and some containing turn-over indicia 86 illustrated by the abbreviations "FUM" and "INT" for the words "Fumble" and "Intercepted". Additionally, some of the offensive blocks 82 contain indicia representing an incompleted pass, shown in columns 3 and 4, and illustrated by the abbreviation "INC" for the word "Incompleted". Further, some of the offensive blocks 82 contain the abbreviation "PEN" indicating a penalty.

As shown in FIG. 5, the yardage indicia 84 can vary from 0 up to 63, and any such magnitude may be represented as long as it is less than the 100 yards on a football field.

Located between the first of the horizontal offensive rows 80 and the headings for each of the four columns is a strip 88 extending across the top of the offensive play board 70, such strip having a sticky substance thereon for the attachment thereto of substitute columns as described in more detail hereinafter. Preferably, the offensive play board 70 is rectangular in shape, is formed of cardboard and has the information illustrated in FIG. 5 printed thereon.

Referring now to FIG. 6, the defensive play board 90 is illustrated therein containing sixteen horizontal defensive rows and six vertical defensive columns each of the latter bearing a label representing a different type of defensive play.

The first defensive column 92 is entitled "Run Type Defense Against Rush or Run", the second defensive column is entitled "Run Type Defense Against Short Pass", the third defensive column 96 is entitled "Run Type Defense Against Long Pass", the fourth defensive column 98 is entitled "Pass Type Defense Against Rush or Run", the fifth defensive column 100 is entitled "Pass Type Defense Against Short Pass", and the sixth defensive column 102 is entitled "Pass Type Defense Against Long Pass".

The sixteen horizontally oriented defensive rows 106 are numbered 3 through 18, once again corresponding to the values of the three dice shown in FIG. 4 and additionally corresponding to the sixteen offensive rows 80 shown in FIG. 5. The intersections of the six defensive columns and the sixteen defensive rows define a plurality of defensive blocks 108, each of which contains numerical defensive yardage indicia 110 comprising various numbers from 0 to 14. Additionally, some of the defensive blocks 108 contain the abbreviations for the turn-over indicia 86 shown in FIG. 5 regarding the offensive play board 70 and as illustrated in FIG. 6 consist of the abbreviations "FUM" and "INT" which represent a fumble or an interception. Similarly, some of the defensive blocks 108 contain the abbreviations "INC" and "PEN" indicating an incompleted pass or a penalty, as similarly shown in FIG. 5.

It is to be noted that the indicia indicating an incompleted pass are restricted in the offensive play board 70 in FIG. 5 to columns 76 and 78 which refer to pass plays and to columns 94, 96, 100 and 102 in the defensive play board 90 which represent defenses against a pass play. A similar placement of the indicia indicating an intercepted pass is shown in FIGS. 5 and 6. The indicia indicating a fumble are scattered throughout various offensive and defensive blocks.

A strip 112 is located above the top defensive row 106 between that row and the headings for the various columns and is provided with a sticky substance, or some other suitable substance, so that substitute defensive columns can be placed on those shown on the defensive play board 90 so as to vary the indicia located in the defensive blocks 108, as to be more fully described hereinafter.

The defensive play board 90 is preferably formed from a rectangularly shaped cardboard sheet with the columns in a vertical orientation and the rows in a horizontal orientation.

Figure 7:
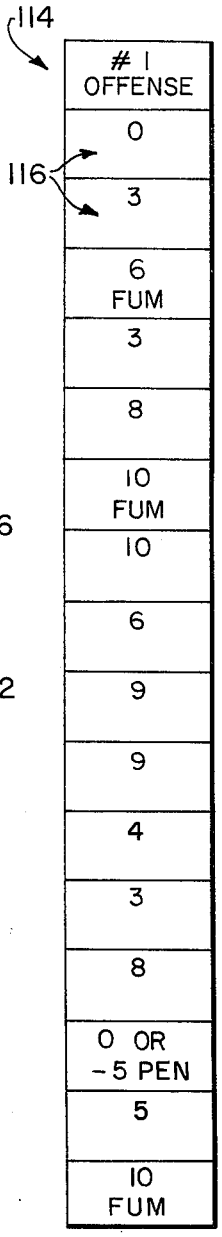
FIGS. 7–10 illustrate substitute offensive columns for varying the indicia located in the offensive blocks on the offensive play board.

Referring now to FIG. 7, a substitute column 114 is shown which has sixteen rows therein defining sixteen substitute offensive blocks 116 which have offensive indicia therein which are different from the indicia shown in the first column 72 in the offensive play board 70 of FIG. 5. This substitute column 114 can be placed on top of the first column 72 shown in FIG. 5 and attached thereto by being stuck to the strip 88 so as to vary the indicia in that column. The substitute column 114 is formed from an elongated rectangular piece of material, such as cardboard, and has a width equal to the width of the first column 72 and a height somewhat longer than that portion of the first column 72 extending from the row numbered 3 to the row numbered 18. When placed over the first column 72 of FIG. 5, the sixteen substitute offensive blocks 116 will completely substitute for the offensive blocks 82 shown in the first column 72.

Figure 8:
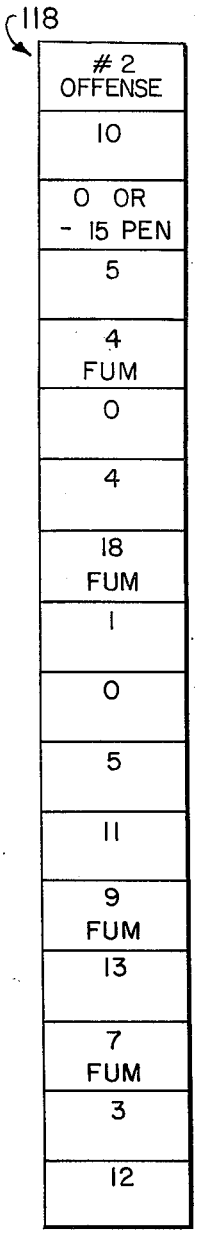
Figure 9:
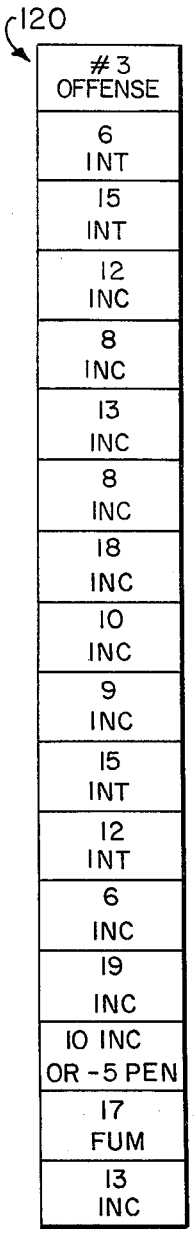
Figure 10:
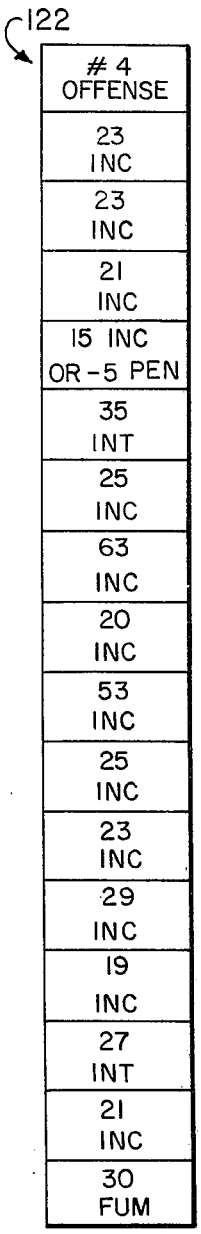

The substitute offensive columns 118, 120 and 122 shown respectively in FIGS. 8, 9 and 10 are constructed in a fashion similar to the substitute column 114 shown in FIG. 7 and are to be substituted, respectively, for the second column 74, the third column 76, and the fourth column 78 shown in FIG. 5. Although only one set of substitute offensive columns are shown in FIGS. 7–10, it is contemplated that a plurality of substitute offensive columns may be provided so as to increase the variation of the offensive indicia contained in the offensive blocks on the offensive play board 70.

Referring now to FIGS. 11, 12, 13 and 14, illustrated therein are a plurality of substitute defensive columns designated 124, 126, 128, 130, 132 and 134. These substitute columns are similar to those shown in FIGS. 7–10, but are to be utilized in conjunction with the defensive play board 90 shown in FIG. 6. It is to be noted that columns 126 and 128, as well as columns 132 and 134, are located on the same rectangular sheet of material, respectively, but could be, alternatively, separated into their own separate sheets. These substitute defensive columns have the same type of indicia as shown in the columns on the defensive play board 90 of FIG. 6 but have different indicia so as to vary the indicia located in the defensive blocks in order to vary the specific outcome of plays capable of being produced by playing the game.

Referring now to FIG. 15, a field goal board 136 is illustrated having field goal yardage columns 138 and field goal rows 140. Five field goal yardage columns 138 are shown and each has a heading corresponding to the position of the playing piece relative to the end zone. Sixteen field goal rows 140 are shown and each is numbered from 3 through 18, corresponding to the value of the dice shown in FIG. 4. The intersection of these rows and the yardage columns define field goal blocks 142, each of which contains the results of the field goal effort. That is, they have a designation of whether the field goal attempt was "good", "bad", or "blocked". Additionally, some of the field goal blocks 142 have a penalty designation therein and a net yardage if the field goal attempt was "bad".

Referring now to FIG. 16, a kick play board 144 is illustrated therein having a kick off column 146, a kick off return column 148, a punt column 150, a punt return column 152, and an on side kick column 154. Additionally, the kick play board 144 has a series of sixteen horizontal rows 156 numbered from 3 through 18 which define at their intersections with the various columns kick off blocks 158, kick off return blocks 160, punt blocks 162, punt return blocks 164, and on side kick blocks 166.

Each of these blocks contains yardage indicia representing the result of the kick off, the kick off return, the punt, the punt return and the on side kick. Additionally, some of these blocks contain a fumble indicia, a penalty indicia or a blocked indicia. The abbreviation "KTB" means that the attempted on side kick was successful and that it is the "kicking team's ball".

OPERATION OF THE FOOTBALL GAME APPARATUS

In playing the game which forms the present invention, the game board 20 is positioned between two players and a flipping of a coin determines which of the two players is to kick off. The winning player kicks off by rolling the three dice and reading the yardage indicia located in the kick off block 158 shown in FIG. 16 on the kick play board 144 corresponding to that row having the same number as the value of the sum of the three dice rolled. The distance of the kick off is shown by the yardage indicia located in that specific kick off block so determined. If the kick off, which started at the forty yard line, went into the opposite end zone on the model football field, it can be returned by the other player or spotted on the twenty yard line. If the kick off landed in the playing field, it can be returned or called a fair catch. If the receiving player decides to return the ball, he or she rolls the three dice and refers to the kick off return block 160 corresponding to the row having the same number as the value of the sum of the three dice so rolled. The yardage indicia in the selected kick off return block is the amount of yardage which the receiving player gained in his return. The playing piece 32 is then positioned along the model football field 22 at the proper location. If a kick off return block 160 was chance selected that had a fumble indicia therein, the possession of the playing piece 32 would change to the player who was kicking off.

A similar operation utilizing the kick play board 144 and the punt column 150 and punt return column 152 is followed when a punt is called for by the player having possession of the playing piece or ball 32. Additionally, an on side kick can be attempted at kick offs, the results thereof being determined by utilizing the on side kick column 154 of the kick play board 144.

A play from scrimmage is accomplished with the player in possession of the ball, the offensive player, utilizing the offensive play board 70 and the three dice togethher with the defensive player utilizing the defensive play board 90 and the three dice. Specifically, the offensive player chooses one of the four columns on the offensive play board 70 and then rolls the three dice. The value of the sum of the three dice selects the offensive row 80 which in turn selects the specific offensive block 82 formed by the intersection of the player selected column and the chance selected row. Additionally, the defensive player chooses broadly either the Run Type Defense set of columns or the Pass Type Defense set of columns shown in FIG. 6 and announces such before learning the offensive play chosen by the offensive player. Aafter the defensive announcement, the defensive player is told of the type of offensive play chosen, which can previously have been written down by the offensive player. The type of offensive play, i.e., either a Rush, Run, Short Pass or Long Pass, chosen determines which column is used on the defensive play board in the set chosen by the defensive player. Thus, if the defensive player chose the Run Type Defense set of columns and if the offensive play is a Rush or Run, then the defensive column is 92, entitled "Run Type Defense Against Rush or Run". If the defensive player chooses the Pass Type Defense set of columns and if the offensive player is a Rush or Run, then the defensive column is 98, entitled "Pass Type Defense Against Rush or Run". After determining which defensive column is to be used, the defensive player rolls the three dice to determine which row is pertinent. The combination of the player selected column and the chance selected row designates a specific defensive block 108 shown on the defensive play board 90 of FIG. 6.

At this time the offensive yardage indicia located in the selected offensive block, and indicating an offensive play value, is compared, or matched, with the defensive yardage indicia, located in the selected defensive block and indicating a defensive play value, so that the resultant play value obtained by subtracting the defensive value from the offensive value indicates the movement of the playing piece 32 in the required direction. In other words, subtracting the defensive value from the offensive value results in a resultant play value so that the playing piece 32 is moved along the model football field 22 a distance indicated by the selected yardage. However, if the offensive block so selected and the defensive block so selected both have matching fumble, incomplete, or intercepted indicia therein, then the playing piece is considered fumbled, the pass is considered incomplete, or the pass is intercepted.

If one of the player's chance selected blocks (offensive or defensive) indicates a penalty, the opposing player has his or her choice of taking the penalty or taking the outcome of the play as in real football. If both players' chance selected blocks indicate a penalty on any one play, the penalties are offset and the play is done over.

If there is a fumble or an interception, the opposing player takes over. If a pass is intercepted or a fumble occurs, the yardage indicia are used to determine where this turn-over has occurred.

The various plays from scrimmage are repeated as in regular football with the ten yard marker 36 being utilized and first downs provided to the offensive player each time more than ten yards is gained in any four plays. The number of plays utilized by both sides in any one quarter is kept track of by the play counter 48 and the time outs, the number of downs left and the number of the quarter are kept track of by the various counters shown in FIG. 1 on the game board 20.

Each time a touchdown is accomplished by the offensive player moving the playing piece 32 into an end zone 26 or 28, an extra point is attempted and then a kick off ensues.

The point after touchdown is accomplished by utilizing the field goal board 136 with the position of the playing piece 32 being correlated to the first field goal yardage column 138 having the ten yards or less designation thereon. As in any regular field goal attempt, the player attempting the field goal or the point after touchdown rolls the dice and reads the results of the attempt in the field goal block 142 corresponding to the horizontal field goal row 140 representing the sum of the three dice. Any field goal attempted which corresponds to the range of the playing piece position on the play board designated by the headings of the columns is determined to be good, bad or blocked by reading the corresponding field goal block 142 corresponding to the roll of the dice.

Thus, an enjoyable and stimulating football match can be played by two players utilizing the football game of the present invention in which both players are actively involved during most of the game's play and wherein each player has a chance to choose the offensive or defensive play he or she desires.

Additionally, by utilizing the substitute offensive and defensive columns shown in FIGS. 7 through 14, the results of the play of the game can be varied to avoid routine results.

While one advantageous embodiment has been chosen to illustrate the subject invention, it will be understood by those skilled in the art that various changes and modifications can be made therein without departing from the scope of the invention as defined in the appended claims.

What is claimed is:

1. A football game apparatus comprising in combination:

a game board having a model football field thereon divided transversely into yardage with end zones at both ends;

a playing piece movable along said game board during each play a yardage distance determined by the comparison of two chance selected values;

means for determining said two chance selected values for each play, said means including an offensive play board having a plurality of offensive blocks thereon, each offensive block containing a chance selected yardage value, and a defensive play board having a plurality of defensive blocks thereon, each defensive block containing a chance selected yardage value; and at least some of said offensive blocks and at least some of said defensive blocks further containing turn-over indicia which, when coinciding in said offensive blocks and said defensive blocks, indicates a turn-over of the playing piece from the offensive player to the defensive player.

2. A football game apparatus according to claim 1 and further including a field goal board having a plurality of yardage columns, each corresponding to the position of said playing piece relative to one of said end zones, and a plurality of rows, one to be selected by chance controlled means, the intersections of said rows and said yardage columns defining field goal blocks containing results of the field goal effort.

3. A football game apparatus according to claim 1 and further including a kick play board including a kick off column and a kick off return column and a plurality of rows, one to be selected by chance controlled means, the intersections of said rows and said kick off column and said kick off return column defining kick off blocks and kick off return blocks, each containing yardage indicia representing the result of the kick off and the result of the kick off return, respectively.

4. A football game apparatus according to claim 3 wherein said kick play board further includes a punt column and a punt return column and a plurality of rows, one to be selected by chance controlled means, the intersection of said rows and said punt column and said punt return column defining punt blocks and punt return blocks, each containing yardage indicia representing the result of the punt and the punt return, respectively.

5. A football game apparatus comprising in combination:

a game board having a model football field thereon divided transversely into yardage with end zones at both ends;

a playing piece movable along said game board yardage;

an offensive play board divided into a plurality of offensive columns, each column bearing a label representing a different type of offensive play, one of which is chosen by the offensive player, and a plurality of offensive rows, one to be selected by a chance controlled means, the intersections of the player selected columns and the chance controlled means selected rows defining a plurality of offensive blocks;

offensive yardage indicia means, located in said offensive blocks, for indicating an offensive play value;

a defensive play board divided into two sets of defensive columns, each column bearing a label representing a type of defensive play against a specified offensive play, one of said sets being chosen by the defensive player and one of said defensive columns in the chosen set being determined by matching said labeled defensive column with the offensive column chosen by the offensive player, and a plurality of defensive rows, one to be selected by a chance controlled means, the intersections of the player selected columns and the chance controlled means selected rows defining a plurality of defensive blocks;

defensive yardage indicia means, located in said defensive blocks, for indicating a defensive play value; and chance controlled means, actuated once by the offensive player and once by the defensive player for each play, for selecting one of said offensive blocks containing offensive yardage indicia means and one of said defensive blocks containing defensive yardage indicia means, which, when tabulated, determine the resultant play value and the movement of said playing piece in the direction indicated by the resultant play value, at least some of said offensive blocks and at least some of said defensive blocks further containing fumble indicia which, when coinciding in said chance selected offensive and defensive blocks for any given play, designates a fumble.

6. A football game apparatus according to claim 5 and further including substitute offensive column means and substitute defensive column means, both placeable on top of said offensive and defensive columns, for varying said offensive yardage indicia means and said defensive yardage indicia means, respectively.

7. A football game apparatus according to claim 6 and further including means for releasably securing said substitute offensive column means and said substitute defensive column means on top of said offensive and defensive columns.

8. A football game apparatus comprising in combination:

a game board having a model football field thereon divided transversely into yardage with end zones at both ends;

a playing piece movable along said game board yardage;

an offensive play board divided into a plurality of offensive columns, each column bearing a label representing a different type of offensive play, one of which is chosen by the offensive player, and a plurality of offensive rows, one to be selected by a chance controlled means, the intersections of the player selected columns and the chance controlled means selected rows defining a plurality of offensive blocks;

offensive yardage indicia means, located in said offensive blocks, for indicating an offensive play value;

a defensive play board divided into two sets of defensive columns, each column bearing a label representing a type of defensive play against a specified offensive play, one of said sets being chosen by the defensive player and one of said defensive columns in the chosen set being determined by matching said labeled defensive column with the offensive column chosen by the offensive player, and a plurality of defensive rows, one to be selected by a chance controlled means, the intersections of the player selected columns and the chance controlled means selected rows defining a plurality of defensive blocks;

defensive yardage indicia means, located in said defensive blocks, for indicating a defensive play value; and chance controlled means, actuated once by the offensive player and once by the defensive player for each play, for selecting one of said offensive blocks containing offensive yardage indicia means and one of said defensive blocks containing defensive yardage indicia means, which, when tabulated, determine the resultant play value and the movement of said playing piece in the direction indicated by the resultant play value, at least some of said offensive blocks and at least some of said defensive blocks further containing incompleted pass indicia which, when coinciding in said chance selected offensive and defensive blocks for any given play, designates an incompleted pass.

9. A football game apparatus comprising in combination:

a game board having a model football field thereon divided transversely into yardage with end zones at both ends;

a playing piece movable along said game board yardage;

an offensive play board divided into a plurality of offensive columns, each column bearing a label representing a different type of offensive play, one of which is chosen by the offensive player, and a plurality of offensive rows, one to be selected by a chance controlled means, the intersections of the player selected columns and the chance controlled means selected rows defining a plurality of offensive blocks;

offensive yardage indicia means, located in said offensive blocks, for indicating an offensive play value;

a defensive play board divided into two sets of defensive columns, each column bearing a label representing a type of defensive play against a specified offensive play, one of said sets being chosen by the defensive player and one of said defensive columns in the chosen set being determined by matching said labeled defensive column with the offensive column chosen by the offensive player, and a plurality of defensive rows, one to be selected by a chance controlled means, the intersections of the player selected columns and the chance controlled means selected rows defining a plurality of defensive blocks;

defensive yardage indicia means, located in said defensive blocks, for indicating a defensive play value; and chance controlled means, actuated once by the offensive player and once by the defensive player for each play, for selecting one of said offensive blocks containing offensive yardage indicia means and one of said defensive blocks containing defensive yardage indicia means, which, when tabulated, determine the resultant play value and the movement of said playing piece in the direction indicated by the resultant play value, at least some of said offensive blocks and at least some of said defensive blocks further containing intercepted pass indicia which, when coinciding in said chance selected offensive and defensive blocks for any given play, designates an intercepted pass.

10. A football game apparatus comprising in combination:

a game board having a model football field thereon divided transversely into yardage with end zones at both ends;

a playing piece movable along said game board yardage;

an offensive play board divided into a plurality of offensive columns, each column bearing a label representing a different type of offensive play, one of which is chosen by the offensive player, and a plurality of offensive rows, one to be selected by a chance controlled means, the intersections of the player selected columns and the chance controlled means selected rows defining a plurality of offensive blocks;

offensive yardage indicia means, located in said offensive blocks, for indicating an offensive play value;

a defensive play board divided into two sets of defensive columns, each column bearing a label representing a type of defensive play against a specified offensive play, one of said sets being chosen by the defensive player and one of said defensive columns in the chosen set being determined by matching said labeled defensive column with the offensive column chosen by the offensive player, and a plurality of defensive rows, one to be selected by a chance controlled means, the intersections of the player selected columns and the chance controlled means selected rows defining a plurality of defensive blocks;

defensive yardage indicia means, located in said defensive blocks, for indicating a defensive play value; and chance controlled means, actuated once by the offensive player and once by the defensive player for each play, for selecting one of said offensive blocks containing offensive yardage indicia means and one of said defensive blocks containing defensive yardage indicia means, which, when tabulated, determine the resultant play value and the movement of said playing piece in the direction indicated by the resultant play value, at least some of said offensive blocks and at least some of said defensive blocks containing penalty indicia which, when coinciding in said chance selected offensive and defensive blocks for any given play, offset each other and when only one of said chance selected blocks contains such penalty indicia the opposing player can take or refuse the penalty.

* * * * *